United States Patent [19]

Ash, Jr.

[11] Patent Number: 4,869,402

[45] Date of Patent: Sep. 26, 1989

[54] PORTABLE BEVERAGE DISPENSER

[76] Inventor: William O. Ash, Jr., 7254 Blanco Rd., No. 100-263, San Antonio, Tex. 78216

[21] Appl. No.: 921,449

[22] Filed: Oct. 22, 1986

[51] Int. Cl.[4] ..... B65D 37/00

[52] U.S. Cl. ..... 222/209; 222/383; 222/386.5; 222/131; 222/389; 206/521

[58] Field of Search ..... 222/206, 213, 214, 215, 222/209, 383, 95, 96, 92, 175, 389, 401, 386, 386.5, 130, 131; 220/449, 469; 206/521

[56] References Cited

U.S. PATENT DOCUMENTS

| | | | |
|---|---|---|---|
| 1,353,236 | 9/1920 | Hatfield | 206/521 |
| 1,366,279 | 1/1921 | Reynolds | 222/214 |
| 2,513,455 | 7/1950 | Cornelius | 222/386.5 |
| 2,529,937 | 11/1950 | Hale | 222/386.5 |
| 3,071,282 | 1/1963 | Walters | 206/521 |
| 3,199,511 | 8/1965 | Kerlick | 222/95 |
| 3,662,929 | 5/1972 | Sims | 222/386.5 |
| 3,756,367 | 9/1973 | Mitchell et al. | 222/386.5 |
| 3,998,359 | 12/1976 | Pettit | 222/386.5 |
| 4,098,434 | 7/1978 | Uhlig | 222/209 |
| 4,300,705 | 11/1981 | Shy | 222/383 |
| 4,703,519 | 10/1987 | Krenzel | 206/521 |

*Primary Examiner*—Joseph J. Rolla
*Assistant Examiner*—Kenneth Noland
*Attorney, Agent, or Firm*—Fleit, Jacobson, Cohn, Price, Holman & Stern

[57] ABSTRACT

The liquid storing volume of rigid dispenser tank is varied by inflation of a gas impermeable bladder with pressurized air to maintain the liquid beverage under pressure. The bladder is inserted or withdrawn from the tank through a releasably sealed opening. The dispenser includes a locked closure positioned in underlying relation to a flexible jacket for the tank.

5 Claims, 3 Drawing Sheets

PORTABLE BEVERAGE DISPENSER

BACKGROUND OF THE INVENTION

1. Field of the Invention

This invention relates to beverage dispensers of the type adapted to be carried on the back of a vendor.

Portable beverage dispensers are generally well known including those adapted to be transported on the back of a vendor by use of a body harness as disclosed by way of example in U.S. Pat. No. 2,684,787 to Charpiat and U.S. Pat. No. 2,808,965 to Grafia et al. Such portable beverage dispensers include a tank made of rigid material enclosing a liquid storing chamber from which the beverage is dispensed and into which the beverage is charged through a reloading valve connected to the bottom of the tank. The beverage is accordingly dispensed under a gravitational pressure head. As an obvious expendient to assist in dispensing of the beverage, particularly when the liquid within the tank becomes depleted, the tank chamber may be internally pressurized with air by means of a pump as disclosed for example in U.S. Pat. No. 3,147,889 to Dolgin. The use of a hand operated piston pump on top of the tank for such purpose was also associated with a commercially available beverage dispenser in publich use for several years, marketed by Brute Enterprises of Houston, Tex. Fluid dispensers that are internally pressurized through a flexible bladder are also known, as disclosed in U.S. Pat. No. 2,513,455 to Cornelius.

It will be apparent that the aforementioned types of prior art beverage dispensers are limited in liquid volume capacity consistent with the dimensional and weight limitations associated with transport of the dispenser by a human vendor. One major factor associated with portable dispensers utilizing a rigid tank is its ability to be internally pressurized without expansion. The strength requirement for the tank is therefore increased so as to require a corresponding increase in material thickness. Further, internal pressurization promotes deterioration of internal tank surfaces so as to limit tank construction to expensive materials such as stainless steel as a practical matter. Also, the internal pressurization of the tank heretofore caused some degradation in the quality of the beverage, such as loss of the carbonation.

It is therefore an important object of the present invention to provide a portable beverage dispenser of the rigid tank type within which the liquid beverage is pressurized to enhance dispensing thereof without the disadvantages aforementioned in connection with the prior art.

An additional object of the present invention in accordance with the foregoing object is to provide a portable beverage dispenser capable of being constructed with lighter materials and reduced thickness, and capable of being more readily serviced and repaired as compared to prior art arrangements.

Yet another object of the present invention is to provide the aforementioned type of rigid tank beverage dispenser that is internally pressurized with air without any adverse effect on the quality of the beverage dispensed. For example, carbonated beverages may be dispensed without loss of carbonation and without any need to inject carbon dioxide into the tank.

SUMMARY OF THE INVENTION

In accordance with the present invention, a portable tank adapted to be mounted on the back of a vendor by means of a body harness, includes a rigid tank of an outer thin gauge material protectively enclosed within a shock absorbent jacket. The liquid beverage storing chamber within the tank is volumetrically varied by means of a flexible bladder disposed within the tank in order to pressurize the liquid stored therein. Toward that end, the air pump inflates the bladder so as to cause volumetric contraction of the tank chamber and pressurization of the liquid stored therein. The bladder is accordingly made of a gas and liquid impermeable material.

The tank is provided with sealable access facilities underlying the outer jacket through which the bladder may be inserted or withdrawn for servicing or replacement. When the tank is being loaded or charged with the liquid beverage, the bladder will collapse to a completely deflated state providing a maximum storage chamber volume within the tank. After the tank is fully loaded with the liquid beverage, a hand pump mounted on the tank is operated to inflate the bladder somewhat thereby reducing the storage chamber volume and pressurizing the liquid therein. Thereafter, the bladder is increasingly inflated by means of the hand pump in step with the depletion of the beverage being dispended. The insulating effect of the outer jacket and the air pressure within the bladder maintaining the liquid pressurized without contact with the air avoids loss of carbonation in connection with carbonated beverages.

Other objects and advantages of the invention will become subsequently apparent from the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 1:
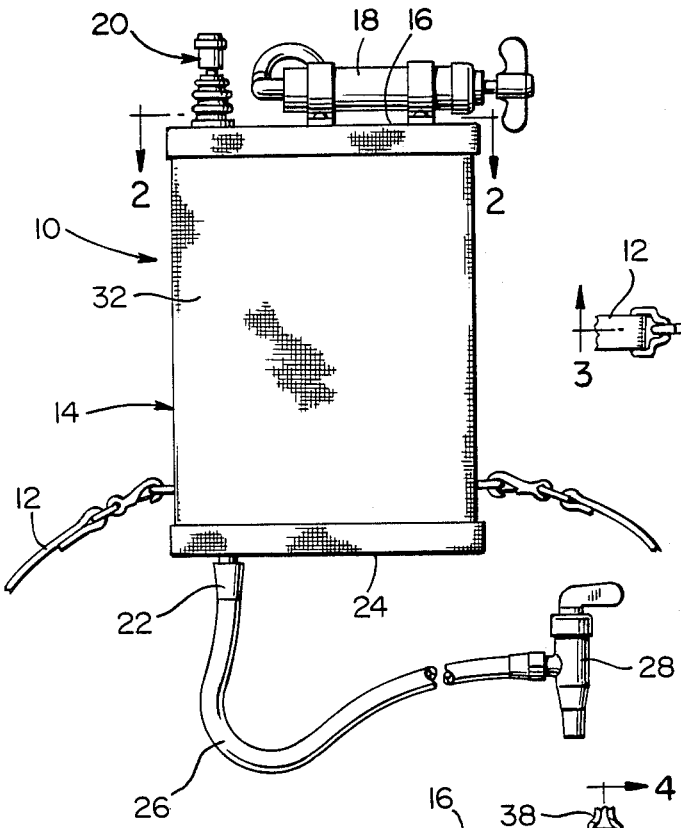
FIG. 1 is a side elevational view of the portable beverage dispenser in accordance with one embodiment of the present invention.
Figure 2:
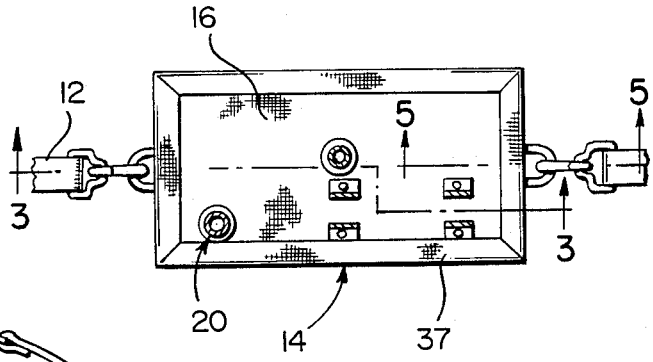
FIG. 2 is a top plan view of the dispenser as viewed from section line 2—2 in FIG. 1.

Referring now to the drawings in detail, FIGS. 1 and 2 illustrates a portable beverage dispenser generally denoted by reference numeral 10 adapted to be carried on the back of a vendor by means of a body harness including the straps 12 in a manner well known in the art. The beverage dispenser 10 includes a generally rectangular tank assembly 14 having an upper axial end 16 on which a piston type hand pump 18 is mounted. Also projecting from the upper end 16 of the tank assembly is a pressure release valve 20 of a well known and commercially available type by means of which the interior of the tank assembly may be depressurized. A liquid beverage reloading and dispensing check valve assembly 22 is connected to and projects from the lower end 24 of the tank assembly and is connected by means of a dispensing hose 26 to a selectively operable dispensing valve 28. The foregoing components of the beverage dispenser are generally well known in the art.

Figure 3:
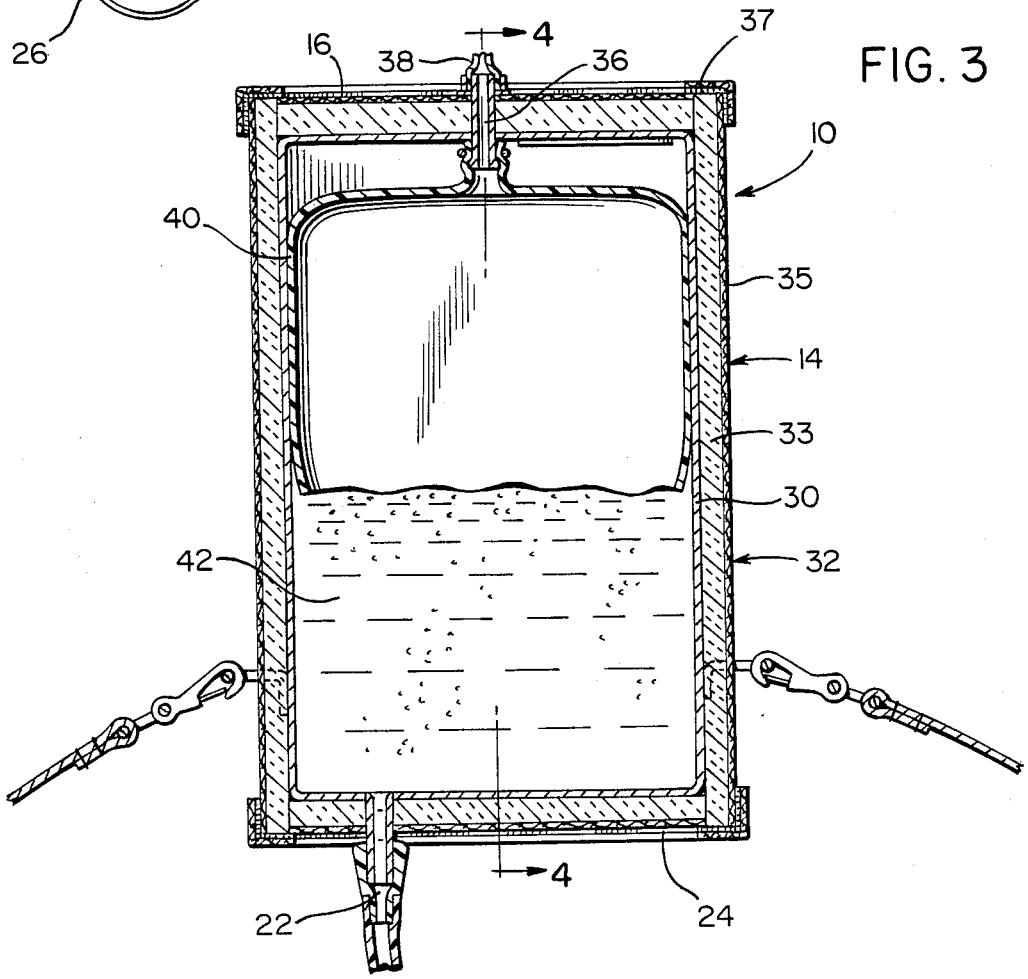
FIG. 3 is an enlarged side section view taken substantially through a plane indicated by section line 3—3 in FIG. 2.

As more clearly seen in FIG. 3, the tank assembly 14 includes a rigid container 30 made of a thin gauge material such as stainless steel or aluminum protectively enclosed by a shock absorbing insulator jacket 32. According to the illustrated embodiment, the jacket 32 has top, bottom and side walls made of a dense foam body 33 in contact with the tank 30 and an outer cover 35 made of a dense woven Nylon-polyester fabric. The top and bottom walls are releasably secured to the side walls by Velcro seams 37.

A beverage loading and dispensing passage 34 extends from the bottom of the tank through the jacket 32 into the reloading valve 22 aforementioned. mentioned. At the upper end of the tank container 30, an air inlet passage 36 is connected by means of a check valve 38 to the pump 18. The passage 36 forms a conduit connection between the pump and a flexible container bladder 40 disposed within the liquid storing chamber 42 enclosed by the rigid tank container 30. The chamber 42 as shown is mostly charged with a carbonated liquid beverage in non-contacting relation to pressurized air maintaining the bladder 40 partially inflated. The bladder 40 forms a common flexible wall between the pressurized air chamber and liquid chamber 42, and is made of a gas and liquid impermeable material such as a multiplastic laminate of biaxial Nylon and metallized polyethylene.

Figure 4:
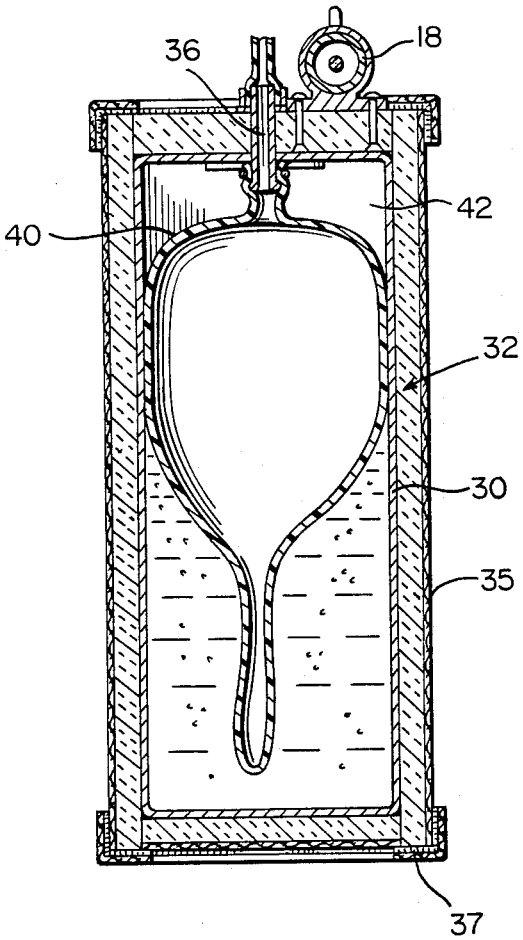
FIG. 4 is a side section view taken substantially through a plane indicated by section line 4—4 in FIG. 3.
Figure 4A:
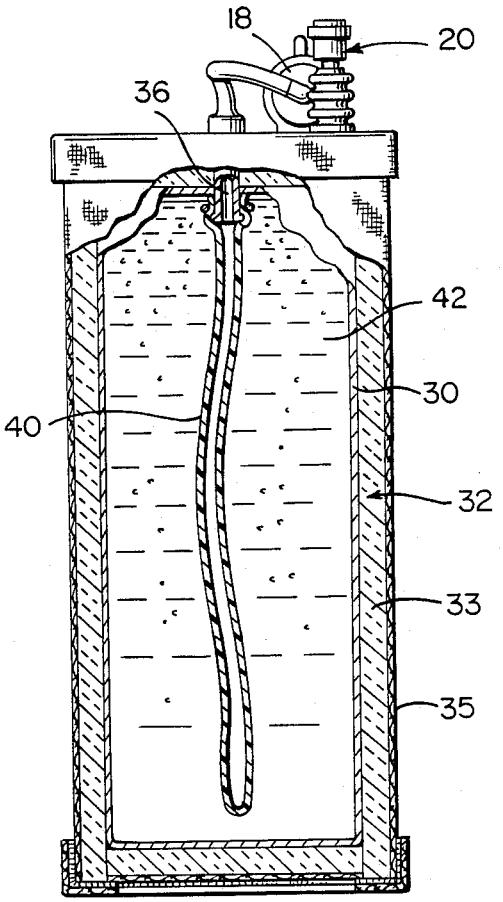
FIG. 4A is a partial side section view corresponding to that of FIG. 4 but showing the dispenser in a fully charged condition.

As shown in FIG. 4, the liquid beverage within the chamber 42 of the tank container 30 is partially depleted and is maintained under pressure by means of the partially inflated bladder 40. When the tank chamber 42 is fully charged or loaded with liquid beverage as shown in Fig. 4A, the bladder 40 is in its fully collapsed condition. It will therefore be apparent that the liquid may be maintained under the desired pressure as the tank chamber 42 is depleted of the liquid, by gradual inflation of the bladder 40 by means of the pump 18. Such inflation of the bladder 40 correspondingly reduces or contracts the volume of the chamber 42 within which the liquid is stored externally of the bladder. Thus, the pressurized air from the pump 18 is confined to the chamber in the bladder which forms a pressure sealed envelope.

Figure 7:
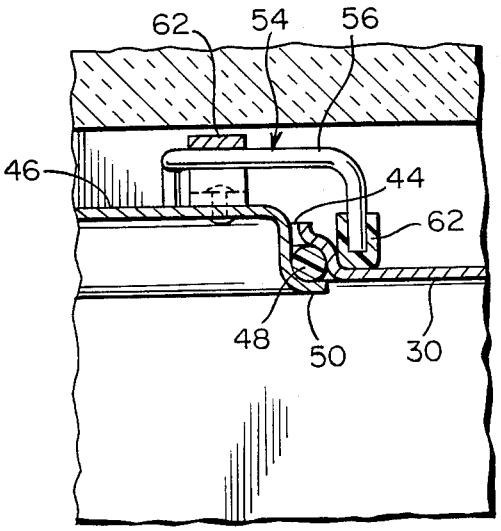
FIG. 7 is a partial section view taken substantially through a plane indicated by section line 7—7 in FIG. 6.
Figure 5:
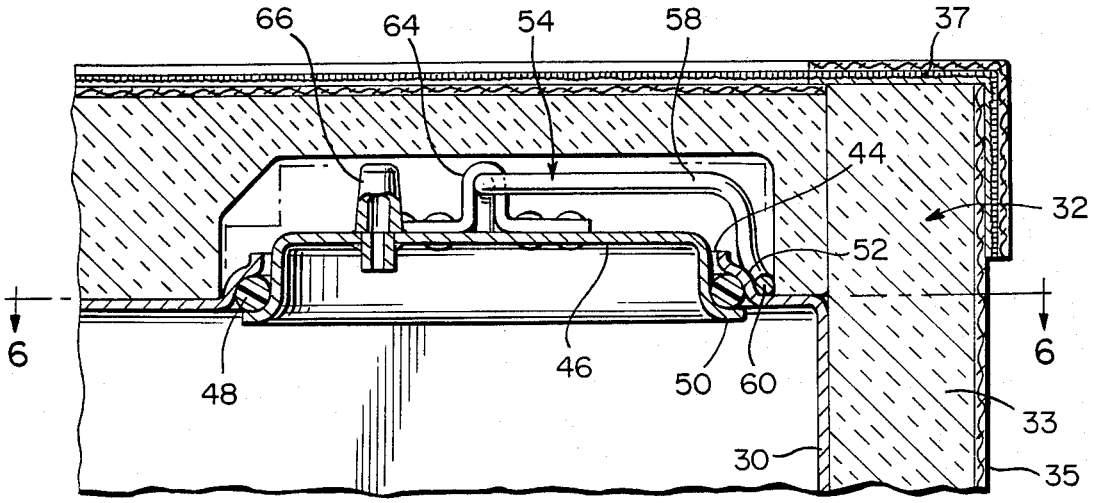
FIG. 5 is an enlarged partial section view taken substantially through a plane indicated by section line 5—5 in FIG. 2.
Figure 6:
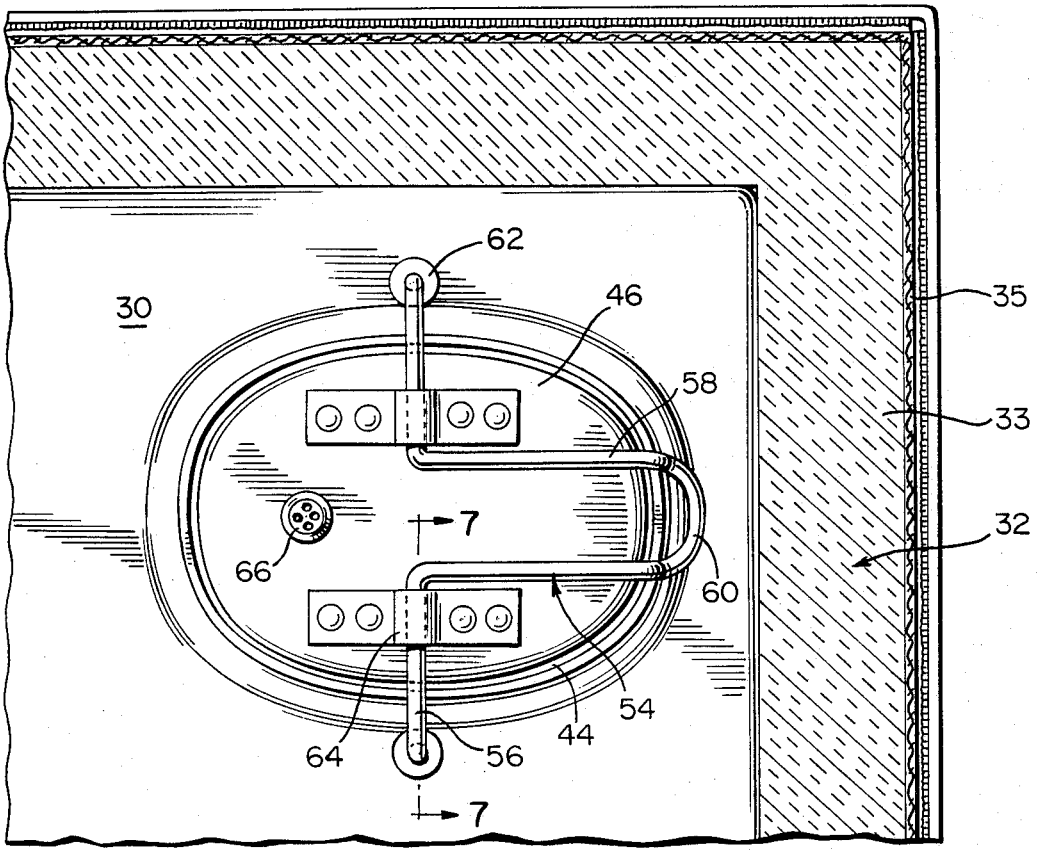
FIG. 6 is a top section view taken substantially through a plane indicated by section line 6—6 in FIG. 5.

The bladder 40 may be inserted or withdrawn from the tank container 30 through an access opening 44 formed in the top of the tank container 30 as shown in FIGS. 5, 6 and 7. The access opening 44 is dimensioned to accommodate such insertion or withdrawal of the bladder 40 is its collapsed state. When the bladder is properly installed and connected to the conduit section 36, the access opening 44 is sealingly closed by an oval shaped closure element 46 on which an annular sealing element 48 is carried. The annular sealing element 48 is clamped, between the underlying flange portion 50 of the closure element and the annular flange 52 on the top of container 30 framing the opening 44, by means of a releasable latch mechanism generally referred to by reference numeral 54. The mechanism 54 includes a pair of axially aligned pivot shaft portions 56 which are interconnected by a U-shaped portion 58 extending at right angles therefrom. The end 60 of the U-shaped portion 58 is curved downwardly for engagement with the top of the tank container 30 at the rim of flange 52 as shown so as to angularly position a pair of leg portions 62 depending from the ends of the shaft portions 56 into frictional engagement with the top of the tank container 30 in the latched condition of the latch mechanism. The shaft portions 56 are pivotally restrained on top of the closure element 46 by means of a pair of pivot brackets 64. To release the closure element 46 from its sealed condition as shown, the U-shaped portion 58 of the releasable latch mechanism 54 is simply pivoted upwardly to thereby angularly displace the leg portions 62 out of engagement with the top of the tank 30. The closure element 46 may then be removed from the opening 44. A pressure relief valve 66 is mounted on the closure element as shown.

Figure 8:
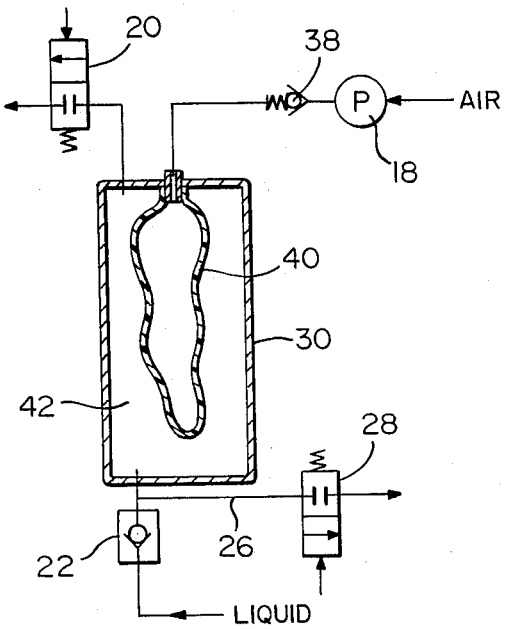
FIG. 8 is a schematic illustration of the pressure and fluid flow system associated with the dispenser of the present invention.

FIG. 8 illustrates schematically the pressure and fluid flow system associated with the portable dispenser herebefore described. As shown, liquid may be loaded into the chamber 42 of the tank container 30 through check valve 22 at the bottom thereof. Once the chamber 42 is filled, the bladder 40 will be ints collapsed state. The chamber 42 will then have its maximum volume. As the liquid within the chamber 42 is depleted, the volume of chamber 42 is correspondingly reduced by inflating the bladder 40 to maintain the liquid under pressure. Inflation of the bladder 40 is accomplished by supplying pressurized air from the pump 18 through check valve 38 into the bladder without any contact between the air and the liquid beverage. Thus, the volume of chamber 42 is varied by inflation or deflation of the bladder 40 in order to maintain the desired pressure on the liquid being dispensed through the selectively operable dispensing valve 28.

In view of the thinness of the tank container 30, the insulator jacket 32 is essential to prevent its rupture. Further, the jacket 32 will provide cushioning comfort for the vendor to whom the dispenser is strapped during use.

From the foregoing, the construction and operation of the beverage dispensing device should be readily understood. Since numerous modifications and changes will readily occur to those skilled in the art, it is not desired to limit the invention to the exact construction shown and described, and accordingly all suitable modification and equivalents may be resorted to, falling within the scope of the appended claims.

What is claimed is:

1. In a portable beverage dispenser having a container within which liquid is stored, a liquid dispensing valve connected to the container and pump means for pressurizing the liquid within the container including, a flexible bladder disposed within the container and passage means connecting the pump means to the bladder for inflation thereof to effect said pressurization of the liquid, said container comprising a relatively rigid wall and flexible jacket means mounted externally on the rigid wall, through which the dispensing valve and the passage means extend, for cushioning and insulating the liquid stored in the container, said pump means being a manually operable air pump, said bladder being made of a gas and liquid impermeable material, the container having an internal liquid storing volume varied by inflation and collapse of the bladder, said rigid wall of the container being formed with an access opening dimensioned to accommodate insertion and withdrawal of the bladder in a collapsed condition and releasably locked closure means mounted within said opening in underlying relation to the jacket means for pressure sealing the container.

2. The claims of claim 1 including an excess pressure relief valve mounted on the closure means.

3. In a dispenser including a container into which liquid is charged, a gas inflatable bladder mounted within the container and passage means connected to the bladder for inflation thereof to effect pressurization of the liquid within the container, the improvement comprising a cushioning jacket mounted externally on the container through which the passage means extends, said container being formed with an access opening spaced from the passage means and dimensioned to accommodate insertion and withdrawal of the bladder in a collapsed condition and releasably locked closure means mounted within said opening in underlying relation to the cushioning jacket for pressure sealing the container.

4. The improvement as defined in claim 3 including an excess pressure relief valve mounted on the closure means.

5. The improvement as defined in claim 3 wherein said cushioning jacket includes an insulating foam body and an outer flexible cover.

* * * * *